US006203879B1

(12) United States Patent
Desai

(10) Patent No.: US 6,203,879 B1
(45) **Date of Patent: *Mar. 20, 2001**

(54) REPEATING SERIES OF CARPET TILES, AND METHOD FOR CUTTING AND LAYING THEREOF

(75) Inventor: Peter Desai, Cartersville, GA (US)

(73) Assignee: Mannington Carpets, Inc., Calhoun, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/065,612

(22) Filed: Apr. 24, 1998

Related U.S. Application Data

(63) Continuation-in-part of application No. 08/957,628, filed on Oct. 24, 1997.

(51) Int. Cl.[7] ..... B32B 3/02

(52) U.S. Cl. ..... 428/88; 428/44; 428/53; 428/54; 428/58

(58) Field of Search ..... 428/88, 53, 54, 428/44, 58

(56) References Cited

U.S. PATENT DOCUMENTS

| | | | | |
|---|---|---|---|---|
| 708,470 | | 9/1902 | Flood . | |
| 1,158,051 | | 10/1915 | Hopkinson . | |
| 2,291,498 | * | 7/1942 | Odell | 428/54 |
| 3,055,785 | * | 9/1962 | Clauson et al. | 428/54 |
| 3,541,243 | | 11/1970 | Whitsel . | |
| 3,621,743 | | 11/1971 | Feighery et al. . | |
| 3,654,051 | * | 4/1972 | Bieler | 428/88 |
| 3,857,749 | | 12/1974 | Yoshida . | |
| 4,172,168 | | 10/1979 | Klaffke et al. . | |
| 4,223,890 | * | 9/1980 | Schoen | 428/44 |
| 4,287,693 | | 9/1981 | Collette . | |
| 4,347,273 | * | 8/1982 | Dale | 428/88 |
| 4,571,353 | | 2/1986 | Gable, Jr. . | |
| 4,620,998 | | 11/1986 | Lalvani . | |
| 4,905,159 | | 2/1990 | Loriot . | |
| 4,942,072 | * | 7/1990 | Chung | 428/88 |
| 4,961,149 | | 10/1990 | Schneider et al. . | |
| 5,052,158 | | 10/1991 | D'Luzansky . | |
| 5,216,614 | | 6/1993 | Kuchta et al. . | |
| 5,324,562 | | 6/1994 | Mullinax et al. . | |
| 5,330,806 | * | 7/1994 | Bythewood et al. | 428/53 |
| 5,333,111 | | 7/1994 | Chaiken et al. . | |
| 5,904,963 | * | 5/1999 | Blatter | 428/53 |

FOREIGN PATENT DOCUMENTS

| | | | | |
|---|---|---|---|---|
| 123985 | * | 1/1928 | (CH) | 428/44 |
| 1006696 | * | 4/1952 | (FR) | 428/44 |
| 1164888 | * | 10/1958 | (FR) | 428/44 |
| 2117777 | * | 12/1970 | (FR) | 428/53 |
| 1729824 | * | 4/1992 | (SU) | 428/53 |

OTHER PUBLICATIONS

Undated Brochure titled "Ultrasonic Cutting and Routing Technology," and Reference List Item 37 from American GFM.

* cited by examiner

*Primary Examiner*—Terrel Morris
*Assistant Examiner*—Sharmistha Gupta
(74) *Attorney, Agent, or Firm*—Finnegan, Henderson, Farabow, Garrett & Dunner

(57) ABSTRACT

A repeating series of tiles has at least three tiles in a series. Each tile within the series has at least one side capable of interfacing with a side of at least one other tile within the series. Each tile within the series has a different shape in the pile direction than the other tiles within the series such that the last tile within the series is capable of interfacing with the first tile of the next series. Further, each tile within the series has at least one side capable of interfacing with at least one tile within another series in order to have adjoining rows of series of tiles. The present invention further includes both a method for producing and assembling a repeating series of tiles.

45 Claims, 7 Drawing Sheets

REPEATING SERIES OF CARPET TILES, AND METHOD FOR CUTTING AND LAYING THEREOF

This application is a continuation-in-part of Ser. No. 08/957,628, filed Oct. 24, 1997.

BACKGROUND OF THE INVENTION

This invention relates generally to flooring segments, which are preferably carpet tiles and, more particularly, to a series of carpet tiles having adjacent surfaces of varying configurations suitable for forming a repeating series of tiles.

Modular carpet tiles are utilized in both household and commercial settings to provide an efficient and cost-effective manner for covering floor surfaces of differing dimensions. As can be seen in FIG. 1, known modular carpet tiles are uniform in circumferential dimensions, and are placed on a surface by abutting the tiles next to each other. Commercial interest in modular carpet tiles is due in part to the advantages of being more readily removed and replaced than traditional floor coverings, and providing relatively simple access to sub-floor space, which makes wiring, cables, plumbing, and the like readily accessible. Because of these advantages over more traditional floor coverings, such tiles are in popular demand.

The use of modular carpet tiles, however, is restrained in several respects. For example, consumers require the installed tiles to have a monolithic look. Consumers expect the finished product to have a seamless, uniform appearance similar to broadloom carpet. Further, an individual installing tiles with a face pattern must carefully orient the tiles to avoid a zippering effect otherwise caused by having offset or overlapping design patterns.

Additionally, modular carpet tiles typically have solid colors or random face patterns in order to facilitate the process of installation by permitting any one tile to be placed next to any other tile. As such, a large number of good carpet styles with non-random patterns made by tufted, woven, knitted, or print processes are excluded from the carpet tile market.

There are further problems known to the art. Generally, modular carpets are cut into square configurations (approximately 18"×18" in size) by utilizing a straight-line die cutting press. In the cutting process, a predetermined length of the carpet (usually three feet for 18"×18" tiles) is advanced onto the press from a roll of 74" wide carpet. Due to the imprecision in most advancement mechanisms, the carpet must be maneuvered slightly more than the predetermined length in order to extend material over the front of the cutting line. Consequently, each cutting stroke of the press typically results in excess carpet waste. Further, the straight-line cutting technique often creates, in the cross direction, frayed edges known as "trailing edges." Moreover, there is no flexibility in the cutting line in that a given die press is fixed for a set dimension. When a change in the tile size is required, the die must be removed and replaced with a new die of differing cutting dimensions, resulting in significantly higher costs and time for the cutting process.

Accordingly, there developed a need for a non-wasteful and efficient method for producing modular carpet tiles of varying dimensions that would allow the use of non-random face patterns and alternative carpet material. Further, there developed a need for carpet tiles that did not result in visible seams after installation, but allowed for more easily installed carpet tiles both with or without non-random face patterns.

SUMMARY OF THE INVENTION

In view of the foregoing considerations and problems known in the art, repeating series of tiles in accordance with one embodiment of the present invention comprises at least three tiles in a series, each tile within the series having at least one side capable of interfacing with a side of at least one other tile within the series, each tile within the series having a different shape in a pile direction than the other tiles within the series such that the last tile within the series is capable of interfacing with the first tile of the next series. Further, each tile within the series preferably has at least one side capable of interfacing with at least one tile within another series to adjoin rows of series of tiles.

In a further aspect of the invention, a method for producing a repeating series of tiles is disclosed comprising the steps of providing tile material, and cutting the tile material into at least three tiles in a series, whereby each tile within the series having at least one side capable of interfacing with a side of at least one other tile within the series, each tile within the series having a different shape in a pile direction than the other tiles within the series such that the last tile within the series is capable of interfacing with the first tile of the next series. The method for producing a repeating series of tiles preferably further includes the substep of cutting each tile within the series such that it has at least one side capable of interfacing with at least one tile within another series to adjoin rows of series of tiles.

In a further aspect of the invention, a method for assembling a repeating series of tiles is disclosed comprising the steps of providing at least three tiles in a series, whereby each tile within the series having at least one side capable of interfacing with a side of at least one other tile within the series, each tile within the series having a different shape in a pile direction than the other tiles within the series such that the last tile within the series is capable of interfacing with a first tile of a next series. Further, the method includes placing each tile in the series on a floor surface adjacent to and in contact with the next tile in the series, and further placing the first tile of the next series on the surface adjacent to and in contact with the last tile of the previous series, and continuing to place tiles within each successive series on the floor surface to form a repeating series of tiles. The method for assembling a repeating series of tiles preferably further includes providing each tile within the series at least one side capable of interfacing with at least one tile within another series to adjoin rows of series of tiles, and placing each tile within the series adjacent to and in contact with a tile within another series to create adjoining rows of series of tiles.

Other aspects and advantages of the invention will be set forth in part in the description which follows, and in part will be apparent from the description, or may be learned by practice of the invention.

BRIEF DESCRIPTION OF THE DRAWINGS

The accompanying drawings, which are incorporated in and constitute part of the specification, illustrate preferred embodiments of the invention and, together with a description, serve to explain the principles of the invention.

In the drawings.

DETAILED DESCRIPTION OF THE PREFERRED EMBODIMENT

Reference will now be made to the present preferred embodiment of the invention, which is illustrated in the accompanying drawings.

Generally, in accordance with an embodiment of the present invention, the repeating series of tiles comprises at least three tiles in a series, each tile within the series having at least one side capable of interfacing with a side of at least one other tile within the series, each tile within the series having a different shape in a pile direction than the other tiles within the series such that the last tile within the series is capable of interfacing with the first tile of the next series.

Figure 2:
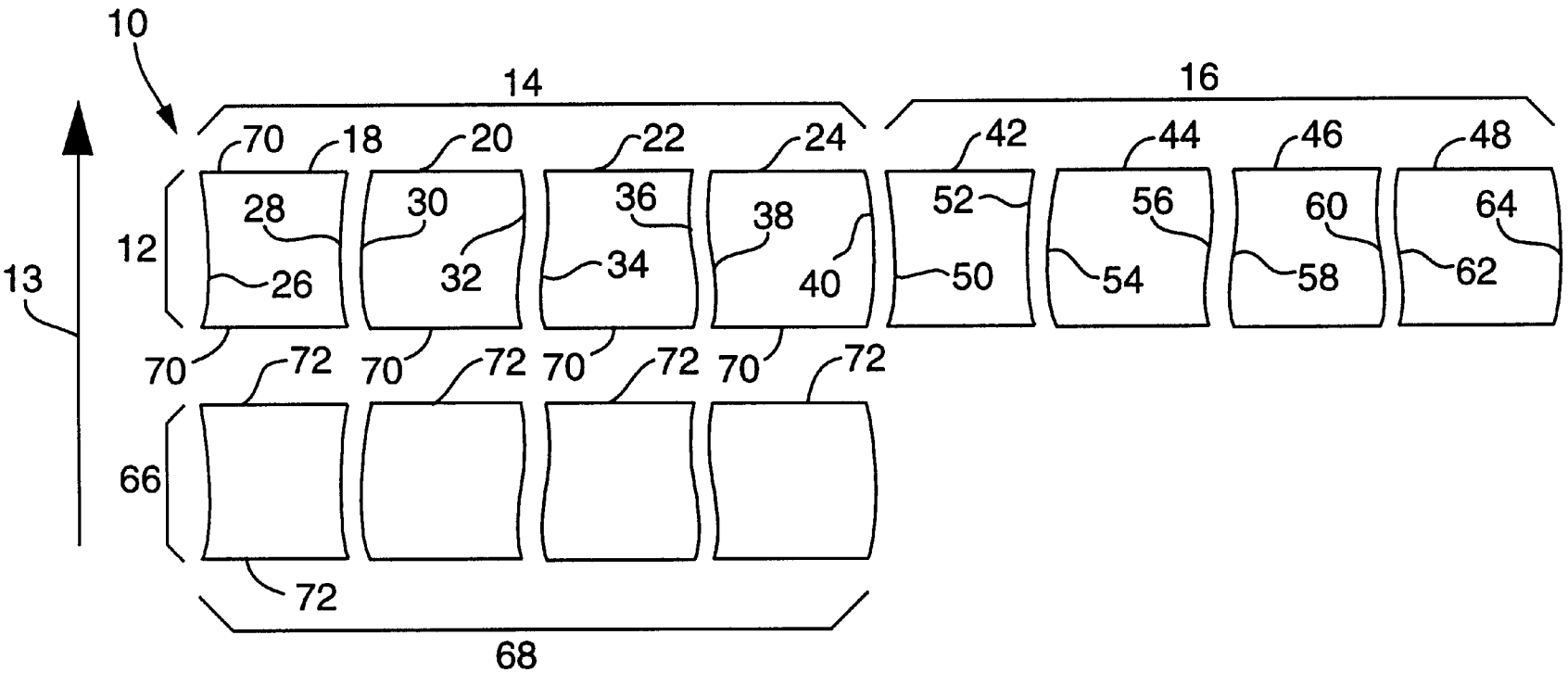
FIG. 2 is a diagrammatic representation of a repeating series of tiles according to one embodiment of the present invention.

As embodied herein and as shown in FIG. 2, a repeating series of tiles is generally depicted by the numeral 10, and is represented as having a multiple series of tiles interconnecting one to another. The repeating series of tiles 10 includes a series 14, which illustrates the base orientation of the tiles. Series 14 should include at least three tiles, whereas here, the series shown has a first tile 18, a second tile 20, a third tile 22, and a fourth or last tile 24. As envisioned, the base series 14 could include a larger number of tiles, but preferably includes at least three in number as is explained later.

Each tile 18, 20, 22, 24 has at least one side capable of interfacing with adjacent tiles within the series 14 or within an adjacent series. That is, first tile 18 has a side 28 capable of interfacing with a side 30 of second tile 20. Further, second tile 20 has another side 32 capable of interfacing with a side 34 of third tile 22, which has another side 36 capable of interfacing with a side 38 of last tile 24, which has another side 40 capable of interfacing with a side of a first tile of the next series. As shown in FIG. 2, the tiles are not in abutting contact, but are represented as being spaced apart from each other. It should be understood that during installation, the tiles would be placed in physical contact with each other.

The series is repeated by placing a second series 16 adjacent to the first series 14, thereby forming a row 12. As further shown in FIG. 2, the second series 16 is identical in configuration to first series 14 such that the first tile 42 of the second series 16 has a side 50 that is capable of interfacing with the side 40 of the last tile 24 of the first series 14.

Figure 11:
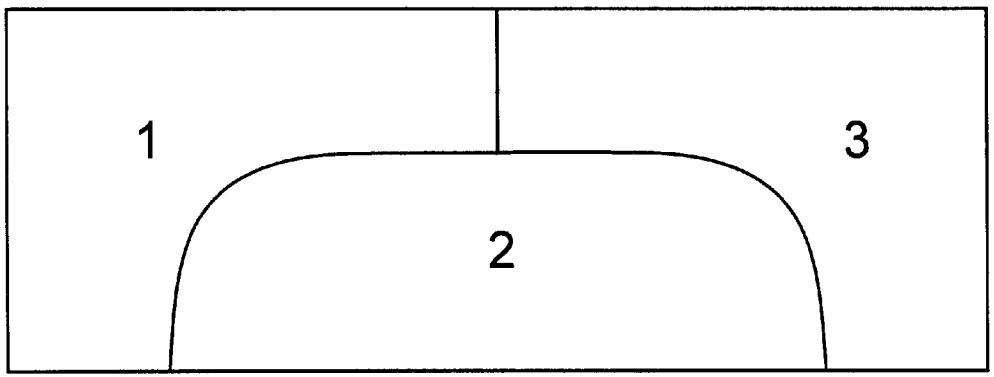
FIG. 11 is another diagrammatic representation of a repeating series of tiles according to another embodiment of the present invention.

In further accordance with the present preferred embodiment of the invention, each tile within the series is generally polygonal (e.g., rhomboidal, triangular, etc.), although other shapes are possible, such as generally circular tiles (not shown), as well as a combination of various shapes as illustrated, for example, in FIG. 11. Further, each series preferably has the same number of tiles, wherein each tile within a series has the same shape as a corresponding tile in another series of tiles. As embodied herein and with continued reference to FIG. 2, each tile 18, 20, 22, 24 is preferably generally square, and the tiles vary from each other in the configuration of their interfacing sides 26, 28, 30, 32, 34, 36, 38, 40. However, the shape of each tile is such that the interfacing side of one tile has a corresponding interfacing side of a tile adjacently located in the series that has an equal and oppositely shaped side. For example, second tile 20 is uniquely configured within the series 14, and further has the side 30 that is mirror opposite in shape to the side 28 of first tile 18, and the second tile 20 further has the side 32 that is mirror opposite in shape to the side 34 of third tile 22. Additionally, each series 14, 16 preferably has the same number of tiles, and each tile in one series has the same shape as another tile in another series. For example, first tiles 18, 42 are identical in shape, as are second tiles 20, 44, third tiles 22, 46, and first tiles 24, 48, respectively. Further, it should be understood that the present descriptions are based upon a tile's pile direction 13, which represent, for example with carpet tiles, the direction that the yarn leans as a result of manufacturing. As with other types of tile materials, the pile direction may be understood to represent an identifiable or pre-marked direction. For example, the piles may be marked on the underside of the tile with a directional arrow or in another like manner. In essence, the use of the term pile direction is used to indicate the positional relationship of the tiles.

By configuring each tile so that it can only interface on either side with a specific tile within the series when the pile is properly oriented, the tiles within each series may be placed on a floor surface in only one correct order. Further, because each series of tiles has the same circumferential shape and the last tile of one series can interface with the first tile of another series, a multiple number of series may be adjoined to create a repeating series of tiles to cover a floor surface. As can be understood by one skilled in the art, by utilizing the same base series, the tiles may be arranged to create a repeating series in order to cover a surface area of a given dimension, which is explained in greater detail later.

In further accordance with a preferred embodiment of the present invention, each tile within the series has at least one side capable of interfacing with a side of at least one tile within another series in order to have adjoining rows of series of tiles. As further embodied herein and with continued reference to FIG. 2, the repeating series of tiles 10 further includes another series of tiles 68 that may be placed adjacent to the first series 14 in order to provide multiple rows of tiles 12, 66. That is, each tile in the first series 14 has an additional side 70 capable of interfacing with a side 72 of a tile in series 68. As shown in FIG. 2, sides 70, 72 are straight surfaces that would allow tiles from different rows 12, 66 to abut against each other when placed on a floor surface. These straight surfaces permit the placement of any of the tiles within a row against any of the tiles of another row.

Figure 1:
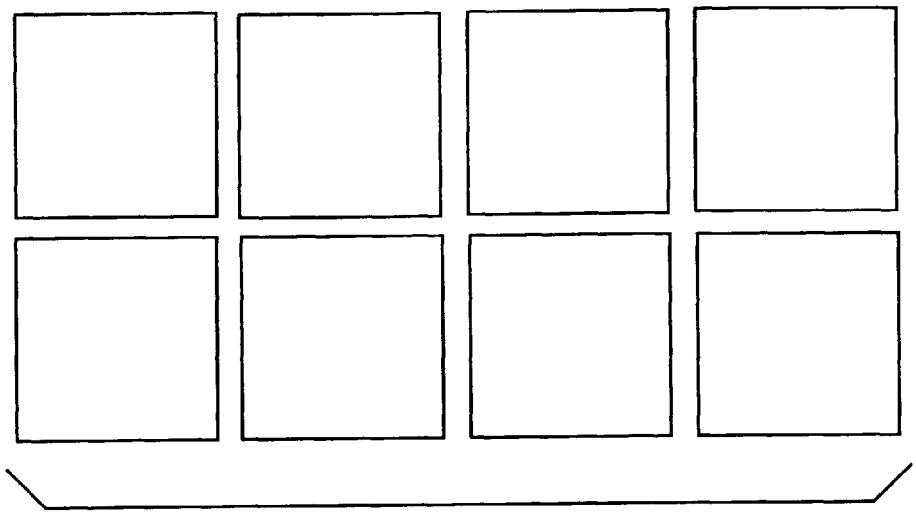
FIG. 1 PRIOR ART
FIG. 1 is a diagrammatic representation of the prior art.
Figure 3:
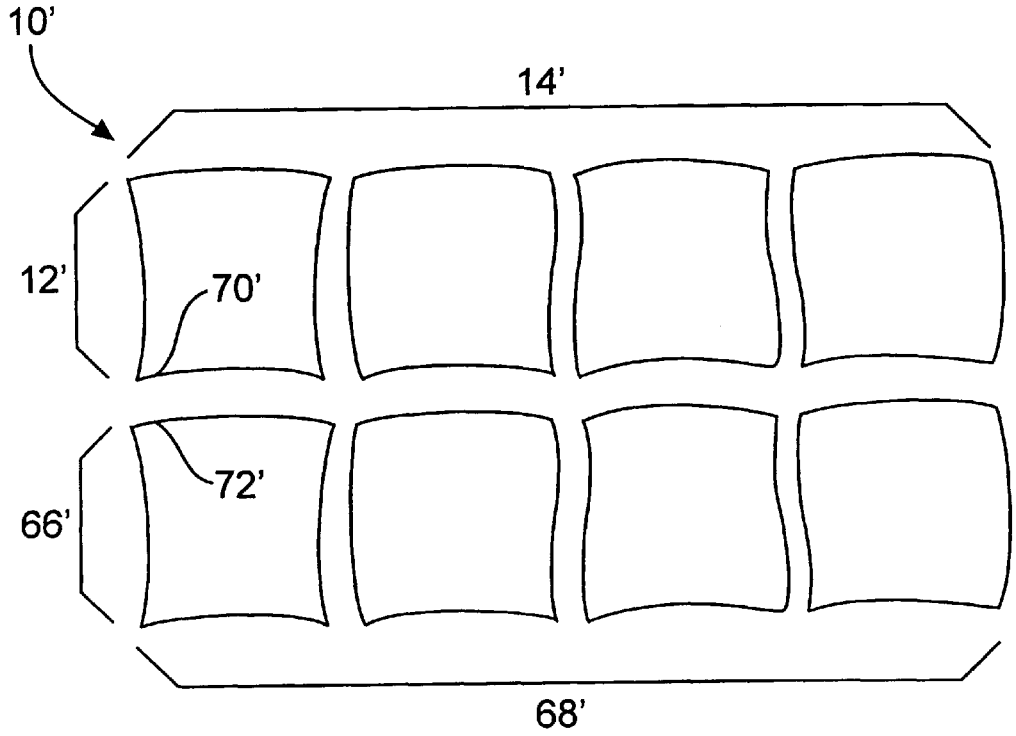
FIG. 3 is another diagrammatic representation of a repeating series of tiles according to another embodiment of the present invention.
Figure 4:
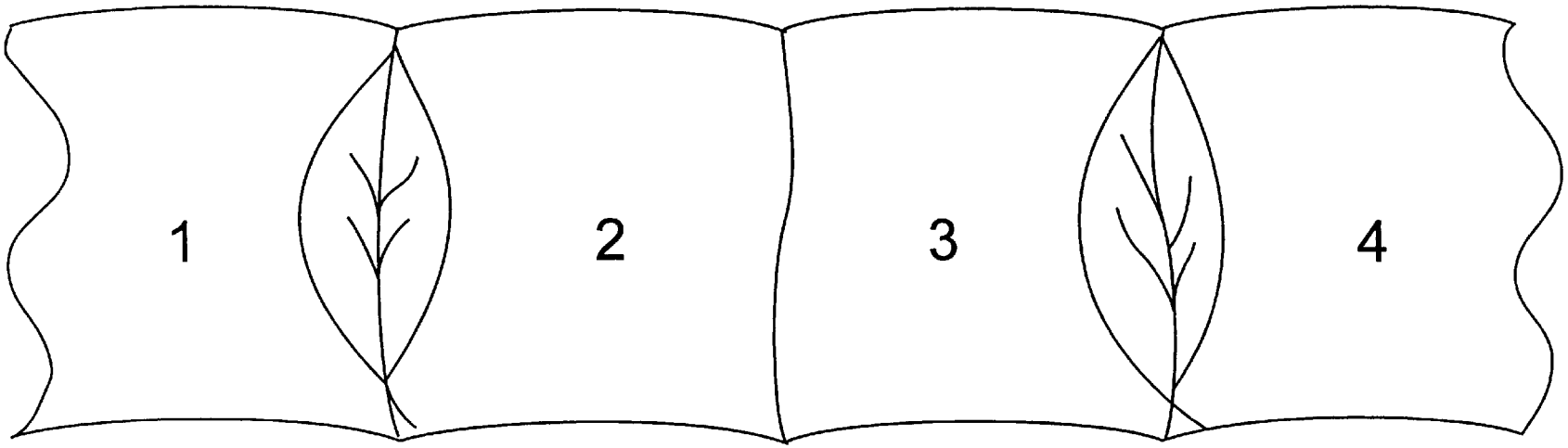
FIG. 4 is another diagrammatic representation of a repeating series of tiles according to another embodiment of the present invention.
Figure 5:
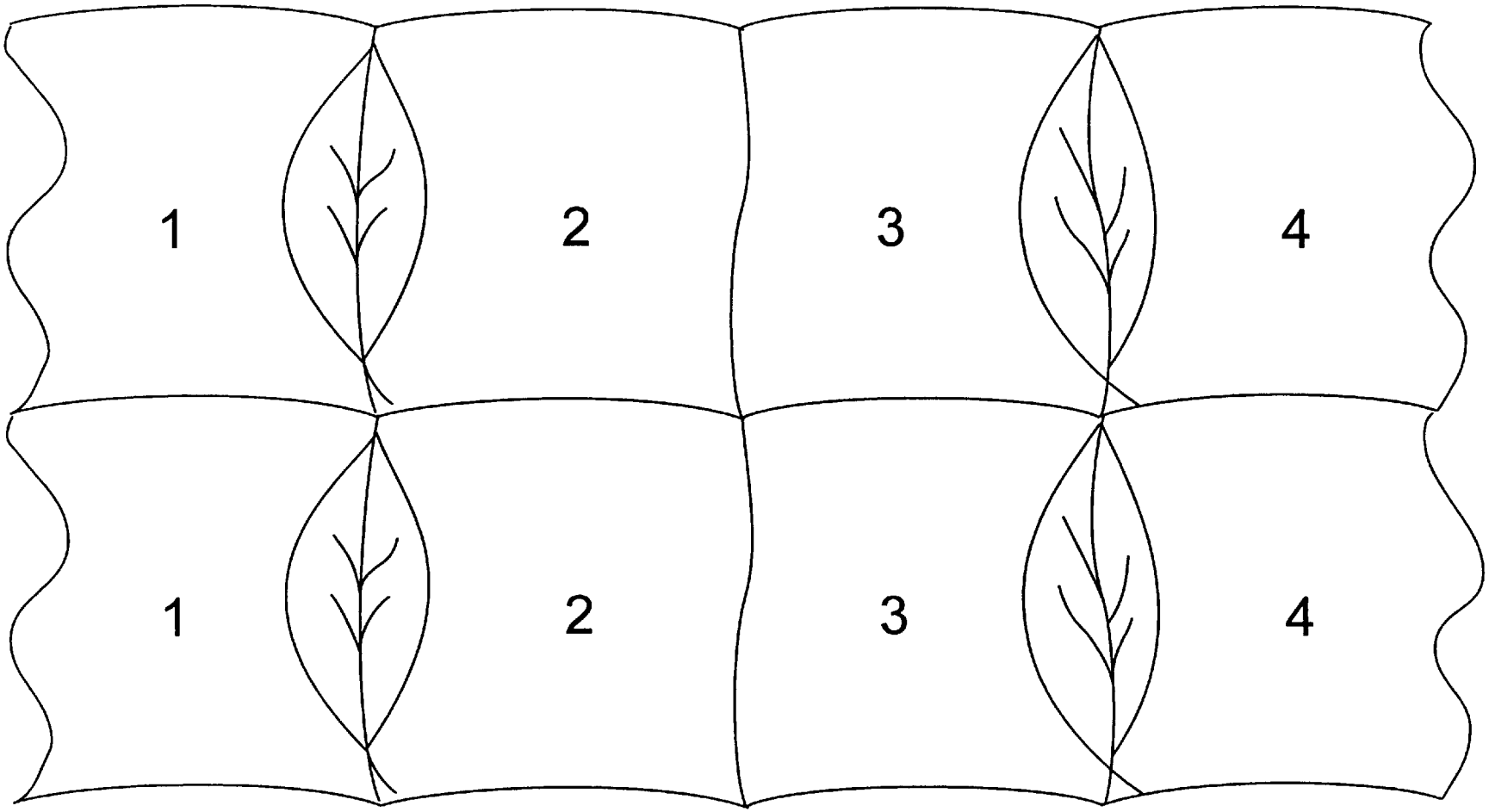
FIG. 5 is another diagrammatic representation of a repeating series of tiles according to another embodiment of the present invention.
Figure 6:
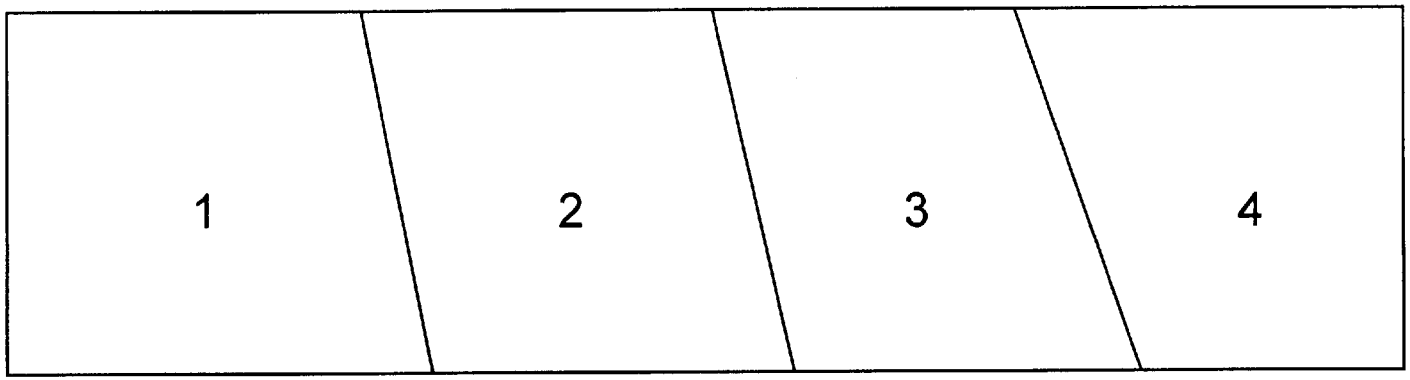
FIG. 6 is another diagrammatic representation of a repeating series of tiles according to another embodiment of the present invention.
Figure 7:
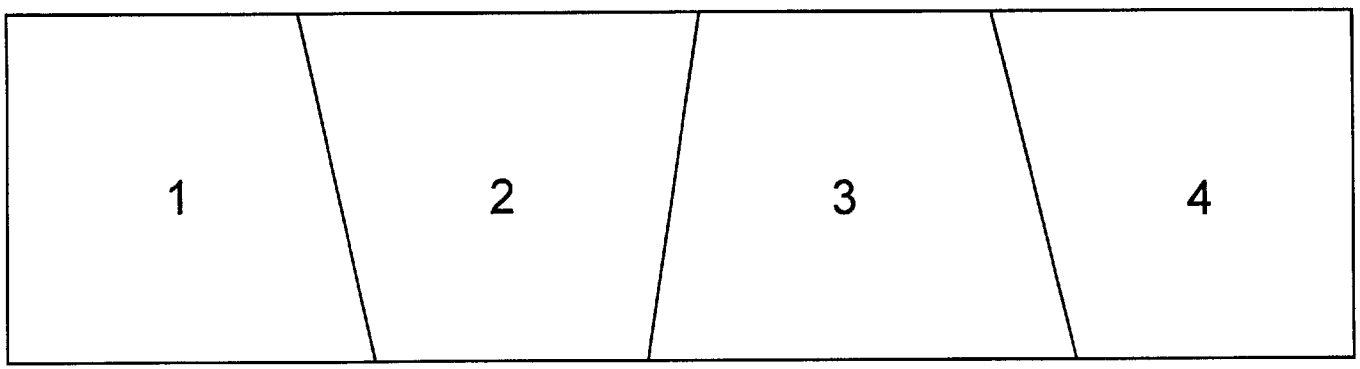
FIG. 7 is another diagrammatic representation of a repeating series of tiles according to another embodiment of the present invention.

An alternative embodiment, as shown in FIG. 3, includes curved surfaces along sides 70', 72' in order to further avoid or minimize the previously discussed problems of zippering. Further still, the illustrated curvatures of sides 70', 72' are only exemplary of the available mating surface designs, and more complex configurations are possible. For example, a given tile's shape in a series can be manufactured so that it will only mate with a specific tile from another series from row to row. Further, by specially configuring the shape of the tiles in the manners discussed, the use of complex patterns on the face of the tiles becomes more practical by increasing the reliability that the placement of the tiles on a floor surface will result in the proper orientation of the face pattern, as can be seen in FIGS. 4 and 5.

Figure 8:
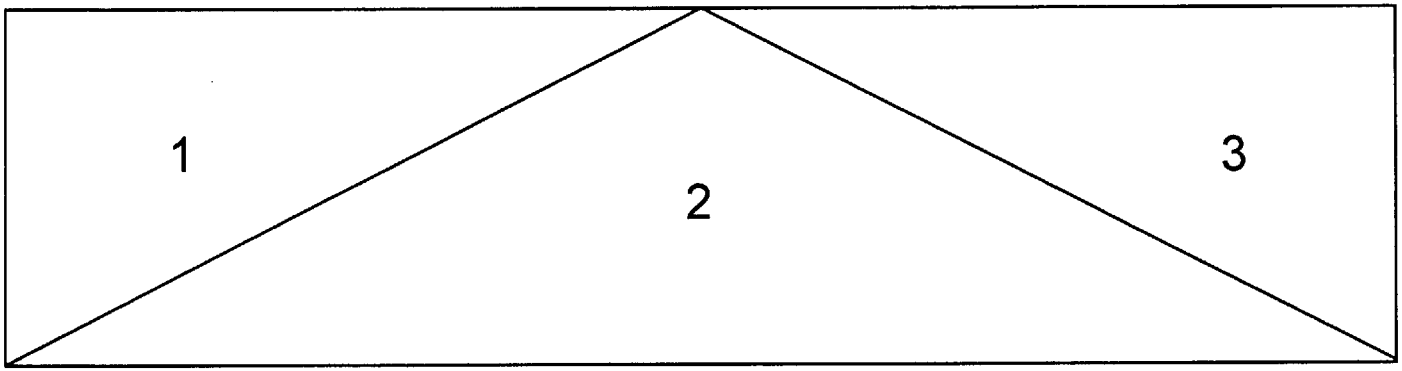
FIG. 8 is another diagrammatic representation of a repeating series of tiles according to another embodiment of the present invention.
Figure 9:
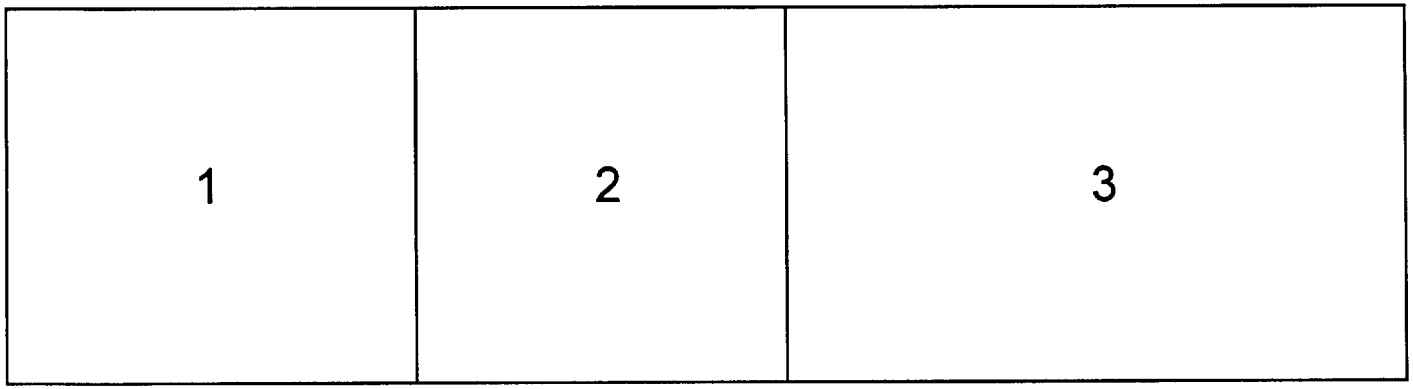
FIG. 9 is another diagrammatic representation of a repeating series of tiles according to another embodiment of the present invention.
Figure 10:
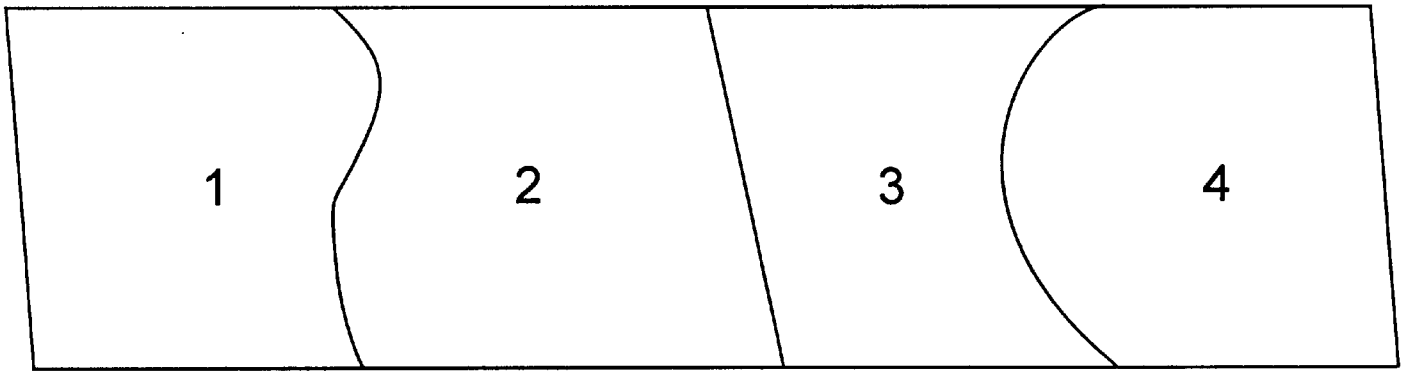
FIG. 10 is another diagrammatic representation of a repeating series of tiles according to another embodiment of the present invention.

The interface shapes between the tiles may vary. For example, as further depicted in FIGS. 6–10, each tile can have sides that are cooperatively angled to mate with the side of an adjacent tile within the series. Such angled interfaces between adjacent tiles can range from 0° to 90° in the pile direction. FIG. 8 in particular illustrates triangular shaped tiles that can be used to create a series of tiles. Also shown, tiles 1 and 3 of FIG. 8 are mirror opposites in shape and in direction. FIG. 9 depicts tiles that may have multiple rectangular shapes in series. Further, FIGS. 10 and 11 illustrate that a series of tiles may have a variety of circumferential shapes, in which each tile within the series has a side that is uniquely configured to mate with a side of at least one other tile within the series. FIG. 11 in particular depicts that tiles within a series may have both generally polygonal and generally circular-type circumferential shapes. One having ordinary skill in the art would further appreciate that each of the series depicted, for example, in FIGS. 6–11 may be reproduced in rows or multiple series, or any combination or sizes in order cover a selected surface.

Producing the Repeating Series of Tiles

Still, in accordance with the present invention, a method for producing a repeating series of tiles is disclosed comprising the steps of: providing tile material; and cutting the tile material into at least three tiles in a series, each tile within the series having at least one side capable of interfacing with a side of at least one other tile within the series, each tile within the series having a different shape in the pile direction than the other tiles within the series such that the last tile within the series is capable of interfacing with the first tile of the next series.

As embodied herein, the tile is generally made from tufted, woven, knitted, printed, patterned-needled punched, fusion bonded or similar carpet-type materials. Other tile materials may be utilized, for example, linoleum, stone (such as marble), ceramic, polymer-based materials (such as rubber, vinyl, resilient vinyl), wood, metal, or other like surface covering materials. A carpet-type material, however, is preferred and the tiles are typically cut from approximately 70–80" wide roll as the roll advances on a cutting press. The carpet is cut into at least three tiles, and preferably four tiles having the shape of the base series 14 or series 14' as shown in FIGS. 2 and 3, with each tile having the approximate dimension of 18"×18" in size. A pneumatically controlled knife (a sharp-edged member) is preferably used to cut the tiles at a high speed. Specifically, the knife is directed to follow the outline of the base series, thereby cutting the individual tiles with single stroke movements. The knife is directed by computer, and the process is repeated to create multiple series of tiles, (e.g., series 14, 16, 68, etc.). By using a knife to cut the material into the shapes depicted in FIGS. 2 and 3, disadvantages of conventional tile cutting systems (die presses) are avoided. The amount of wasted material is reduced, and the mistakes associated with installation are likewise reduced because the tiles can only be installed sequentially by series in order to fit properly on the floor. Further, the necessity of removing and replacing die presses is obviated by utilizing a tool adapted to cut tiles into a wide range of dimensions. Other cutting methods may be employed, for example, high pressure water jets, lasers, burning, etc. in order to produce the desired sequential tile shapes.

Although here, it is described that four tiles are cut from a roll of carpet to produce the shapes of the tiles depicted in FIGS. 2 and 3, any number of tiles may be cut from a roll of material depending on the operator's election on a base series design. The dimensional sizes of the tiles may be reduced to allow for more tiles cut from a roll of material, or the width of the material may be increased to allow for the production of larger tiles from a given cross-section. Further, through this cutting step, the shape of a preferred tile side may have deviations from a straight line up to about 6.0" or more depending on the configuration, for example, for tiles having an approximate area of 18"×18" to 36"×36". However, it is understood that a tile may alternatively have one or more a straight sides. Also, when a series of tiles is cut in a row, each tile can be cut with a different shape to avoid or minimize zippering or face pattern misalignment at modular seams when installed, in addition to achieving the other advantages that are described and that are apparent.

Assembling the Repeating Series of Tiles

In further accordance with another embodiment of the present invention, a method for assembling a repeating series of tiles is disclosed comprising the steps of: providing a repeating series of tiles having at least three tiles in a series, each tile within the series having at least one side capable of interfacing with a side of at least one other tile within the series, each of the two sides of each tile within the series having a different shape in the pile direction than the other tiles within the series such that the last tile within the series is capable of interfacing with a first tile of a next series; and placing each tile in the series on a floor surface adjacent to and in contact with the next tile in the series, and further placing the first tile of the next series on the surface adjacent to and in contact with last tile of the previous series, and continuing to place tiles within each successive series on the floor surface to form a repeating series of tiles.

As embodied herein, the tiles are installed sequentially by each series in order to place them in a proper fit on a floor surface. As can be envisioned from FIG. 2, a series 14 is installed by placing the first tile 18 on the floor surface. Preferably, a glue or other suitable adherent is used on the underside of each tile to secure it to the surface. The glue or adherent may be of the type that is put on the underside of the tile during the manufacturing process, or of the type that is applied to the floor prior to placement of the tile thereto, or a combination thereof. The second tile 20 is placed in abutting contact adjacent to the first tile 18 such that side 28 and side 30 interface. Likewise, the third tile 22 is placed so that sides 32, 34 interface, and then the last tile 24 is placed so that sides 36, 38 interface. The first tile 42 of the next series 16 is placed adjacent to the last tile 24 of the first series 14. The step is repeated as is required to cover a given surface area. Of course, the successive series of tiles may be placed in interfacing relationships by moving from a starting tile to either the left or right or both. Further, series 68 may be placed adjacent to series 14, and so on, to create a broadloom appearance. In placing the tiles, one skilled in the art would appreciate that the tiles may need to be cut by the use of a hand tool in order to fit pieces next to walls or around columns, etc. The sequential placement of the repeating series of tiles of different shapes avoids or minimizes zippering or face pattern misalignment at modular seams, and provides a relatively easy method for installing floor covering. Additionally, face patterns of complex designs may be recreated by assembling the repeating series.

Further, it should be appreciated that a series can begin with any tile in a series. Although the above descriptions and the drawings depict a given series starting with a first tile, for example tile 18, a given series may begin with any tile in the series and the remaining tiles placed thereafter. That is, for example, second tile 20 may be installed first with tiles 22, 24, 18 following, where tile 18 will then become the last tile installed in the series. As such, the next series would begin with tile 44, and continue with tiles 46, 48, 42, etc. This provides for a simplistic method of installing the tiles in that the installer can begin with any tile in the series and install the remaining tiles accordingly.

It will be apparent to those skilled in the art that modifications and variations can be made in the above-described embodiments of the present invention without departing from the scope or spirit of the invention. Thus, it is intended that the present invention cover such modifications and variations provided they come within the scope of the appended claims and their equivalents.

What is claimed is:

1. A repeating series of tiles comprising:

at least three tiles in a series, each tile within the series having at least one side capable of interfacing with a side of at least one other tile within the series, and a different shape in a pile direction than the other tiles within the series such that a last tile within the series has a curvilinear side shaped to match a complimentary side of a first tile of a next series of tiles.

2. A repeating series of tiles of claim 1, wherein each tile within the series has at least one side capable of interfacing with a side of at least one tile within another series so as to form adjoining rows of series of tiles.

3. The repeating series of tiles of claim 1, wherein each tile within the series has at least one side uniquely configured to mate with a side of at least one other tile within the series.

4. A repeating series of tiles of claim 1, wherein the shape of each tile within the series is selected from one of a group consisting of generally polygonal and generally circular shaped tiles.

5. The repeating series of tiles of claim 1, wherein each tile within the series has the same shape as a corresponding tile in another series of tiles.

6. The repeating series of tiles of claim 1, wherein each series has the same number of tiles.

7. The repeating series of tiles of claim 1, wherein at least two tiles in the series are capable of being oriented to have a face pattern.

8. The repeating series of tiles of claim 1, wherein each series of tiles is capable of being oriented with another series of tiles in order to have a face pattern.

9. The repeating series of tiles of claim 1, wherein the side of each tile is cooperatively angled to mate with a side of an adjacent tile within the series.

10. A repeating series of tiles of claim 1, wherein the tiles are selected from one of a carpet, linoleum, stone, ceramic, polymers, wood, or metal material.

11. The repeating series of tiles of claim 1, wherein the last tile within the series has a curvilinear side configured to interface with a complimentary side of the first tile of the next series of tiles.

12. The repeating series of tiles of claim 1, wherein the last tile within the series is adjoined to the first tile of the next series of tiles so as to define a row of tiles.

13. The repeating series of tiles of claim 1, wherein each of the tiles include carpet tiles, and the pile direction represents a direction of yarn lean.

14. The repeating series of tiles of claim 1, wherein each of the tiles are marked so as to indicate a predetermined positional relationship of the tiles.

15. The repeating series of tiles of claim 1, wherein each of the tiles are shaped so as to be placed together in a predetermined sequential order.

16. The repeating series of tiles of claim 15, wherein each of the tiles are marked so as to indicate the predetermined sequential order.

17. A repeating series of tiles comprising:

at least three tiles in a series, each tile within the series having at least one side capable of interfacing with a side of at least one other tile within the series, each tile within the series having a different shape in a pile direction than the other tiles within the series such that a last tile within the series is capable of interfacing with a first tile of a next series of tiles, each tile within the series having at least one side capable of interfacing with at least one tile within another series of tiles in order to have adjoining rows of series of tiles, each tile within the series having the same shape as a corresponding tile in another series of tiles.

18. The repeating series of tiles of claim 17, wherein the tiles are carpet.

19. A repeating series of tiles comprising:

at least three tiles in a series, each tile within the series having at least two sides capable of interfacing with at least one of adjacent tiles within the series and a tile from another series of tiles, and a different shape in a pile direction than the other tiles within the series such that a last tile within the series has a curvilinear side shaped to match a complimentary side of a first tile of a next series of tiles, and wherein the last tile within the series is adjoined to the first tile of the next series of tiles so as to define a row of tiles.

20. The repeating series of tiles of claim 19, wherein each tile within the series is generally polygonal, each tile within the series has at least one side capable of interfacing with a side of at least one tile within another series in order to have adjoining rows of series of tiles, each tile within the series has the same shape as a corresponding tile in another series of tiles.

21. The repeating series of tiles of claim 19, wherein each of the tiles include carpet tiles, and the pile direction represents a direction of yarn lean.

22. The repeating series of tiles of claim 19, wherein each of the tiles are marked so as to indicate a predetermined positional relationship of the tiles.

23. The repeating series of tiles of claim 19, wherein each of the tiles are shaped so as to be placed together in a predetermined sequential order.

24. The repeating series of tiles of claim 23, wherein each of the tiles are marked so as to indicate the predetermined sequential order.

25. A method for producing a repeating series of tiles comprising the steps of: providing tile material; and cutting the tile material into at least three tiles in a series, each tile within the series having at least one side capable of interfacing with a side of at least one other tile within the series, and a different shape in a pile direction than the other tiles within the series such that a last tile within the series has a curvilinear side shaped to match a complimentary shape a first tile of the next series.

26. The method of claim 25, wherein the cutting step includes the substep of cutting each tile within the series such that it has at least one side capable of interfacing with a side of at least one tile within another series in order to have adjoining rows of series of tiles.

27. The method of claim 25, wherein the cutting step includes the substep of cutting each tile within the series such that it has at least one side that is cooperatively angled to mate with a side of an adjacent tile within the series.

28. The method of claim 25, wherein the cutting step may be accomplished by a cutting mechanism selected from one of a knife, pressurized water, a laser, and a pneumatically controlled knife.

29. The method of claim 25, wherein the cutting step includes the substep of cutting each tile within the series such at least two tiles in the series are capable of being oriented to have a face pattern.

30. The method of claim 25, wherein the cutting step includes the substep of cutting each tile within the series such that each series of tiles is capable of being oriented with another series of tiles in order to have a face pattern.

31. The method of claim 25, wherein the cutting step includes the substep of cutting the last tile within the series and the first tile of the next series of tiles such that the last tile within the series is configured to be adjoined to the first tile of the next series so as to define a row of tiles.

32. The method of claim 25, further comprising the step of marking each of the tiles so as to indicate a predetermined positional relationship of the tiles.

33. The method of claim 25, wherein the cutting step includes the substep of cutting each tile within the series into a predetermined shape so that each tile is placed together within the series in a predetermined sequential order.

34. The method of claim 33, further comprising the step of marking each of the tiles so as to indicate the predetermined sequential order.

35. The method of claim 25, further comprising the step of placing together each of the tiles within the series in a predetermined sequential order.

36. A method for assembling a repeating series of tiles comprising the steps of:

providing a repeating series of tiles having at least three tiles in each series, each tile within the series having at least one side capable of interfacing with a side of at least one other tile within the series, and a different shape in a pile direction than the other tiles within the series such that a last tile within the series has a curvilinear side shaped to match a complimentary shape of a first tile of a next series of tiles;

placing each tile in the series on a floor surface adjacent to and in contact with the next tile in the series, and further placing the first tile of the next series on a surface adjacent to and in contact with the last tile of the previous series; and continuing to place tiles with each successive series on the floor surface to form a repeating series of tiles.

37. The method of claim 36, wherein the providing step includes the substep of providing each tile within the series having at least one side capable of interfacing with at least one tile within another series in order to have adjoining rows of series of tiles, and wherein the placing step includes the substep of placing each tile within the series adjacent to and in contact with a tile within another series to create adjoining rows of series of tiles.

38. The method of claim 36, wherein the placing step orients the tiles to provide a face pattern with the series.

39. The method of claim 36, wherein the placing step and the continuance of that step orients each series of tiles to another series of tiles to form a series of face patterns.

40. The method of claim 36, wherein the placing step and the continuance of that step orients each series of tiles to another series of tiles to form a face pattern.

41. The method of claim 36, wherein the providing step includes the substep of cutting the last tile within the series and the first tile of the next series of tiles such that the last tile within the series is configured to be adjoined to the first tile of the next series so as to define a row of tiles.

42. The method of claim 36, further comprising the step of marking each of the tiles so as to indicate a predetermined positional relationship of the tiles.

43. The method of claim 36, wherein the cutting step includes the substep of cutting each tile within the series into a predetermined shape, and the placing step includes the step of placing each tile together in a predetermined sequential order based on the predetermined shape of each tile within the series.

44. The method of claim 43, further comprising the step of marking each of the tiles so as to indicate the predetermined sequential order.

45. The method of claim 36, wherein the placing step includes the substep of placing together each of the tiles within the series in a predetermined sequential order.

* * * * *

UNITED STATES PATENT AND TRADEMARK OFFICE

CERTIFICATE OF CORRECTION

PATENT NO. : 6,203,879 B1
DATED : March 20, 2001
INVENTOR(S) : Peter Desai

It is certified that error appears in the above-identified patent and that said Letters Patent is hereby corrected as shown below:

Claim 1, column 7,
Line 33, "complimentary" should read -- complementary -- .

Claim 11, column 7,
Line 66, "comlimentary" should read -- complementary -- .

Claim 13, column 8,
Lines 4-5, "each of the tiles include" should read -- each of the tiles includes -- .

Claim 14, column 8,
Lines 7-8, "each of the tiles are marked" should read -- each of the tiles is marked -- .

Claim 15, column 8,
Lines 10-11, "each of the tiles are shaped" should read -- each of the tiles is shaped -- .

Claim 16, column 8,
Lines 13-14, "each of the tiles are marked" should read -- each of the tiles is marked -- .

Claim 19, column 8,
Line 38, "complimentary" should read -- complementary -- .

Claim 21, column 8,
Lines 49-50, "each of the tiles include" should read -- each of the tiles includes -- .

Claim 22, column 8,
Lines 52-53, "each of the tiles are marked" should read -- each of the tiles is marked -- .

Claim 23, column 8,
Lines 55-56, "each of the tiles are shaped" should read -- each of the tiles is shaped -- .

UNITED STATES PATENT AND TRADEMARK OFFICE

CERTIFICATE OF CORRECTION

PATENT NO. : 6,203,879 B1
DATED : March 20, 2001
INVENTOR(S) : Peter Desai

It is certified that error appears in the above-identified patent and that said Letters Patent is hereby corrected as shown below:

Claim 24, column 8,
Lines 58-59, "each of the tiles are marked" should read -- each of the tiles is marked -- .

Claim 25, column 9,
Line 2, "complimentary shape a first tile" should read -- complementary shape of a first tile -- .

Claim 29, column 9,
Line 19, after "such", insert -- that -- .

Claim 36, column 10,
Line 2, "complimentary" should read -- complementary -- .

Signed and Sealed this

Twentieth Day of November, 2001

*Attest:*

Nicholas P. Godici

NICHOLAS P. GODICI
*Acting Director of the United States Patent and Trademark Office*

*Attesting Officer*